US009342011B2

(12) United States Patent
Watatani

(10) Patent No.: US 9,342,011 B2
(45) Date of Patent: May 17, 2016

(54) FIXING DEVICE COMPRISING HEAT INSULATING MEMBER TO COVER OUTER CIRCUMFERENCE OF FIXING MEMBER AND IMAGE FORMING APPARATUS INCLUDING THE SAME

(71) Applicant: KYOCERA Document Solutions Inc., Osaka (JP)

(72) Inventor: Tomohiro Watatani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/739,874

(22) Filed: Jun. 15, 2015

(65) Prior Publication Data

US 2015/0370201 A1 Dec. 24, 2015

(30) Foreign Application Priority Data

Jun. 24, 2014 (JP) ..... 2014-129067

(51) Int. Cl.
*G03G 15/20* (2006.01)

(52) U.S. Cl.
CPC ..... *G03G 15/206* (2013.01); *G03G 15/2017* (2013.01)

(58) Field of Classification Search
CPC ..... G03G 15/20–15/2096
See application file for complete search history.

(56) References Cited

U.S. PATENT DOCUMENTS

2002/0001481 A1* 1/2002 Kiuchi ..... G03G 15/2064 399/122
2009/0142113 A1* 6/2009 Kajita ..... G03G 15/206 399/328
2012/0308254 A1* 12/2012 Suzuki ..... G03G 15/2053 399/90
2014/0301751 A1* 10/2014 Takagi ..... G03G 15/2032 399/67

FOREIGN PATENT DOCUMENTS

JP H07-064422 A 3/1995

* cited by examiner

*Primary Examiner* — Clayton E Laballe
*Assistant Examiner* — Ruifeng Pu
(74) *Attorney, Agent, or Firm* — Studebaker & Brackett PC

(57) ABSTRACT

A fixing device includes a fixing member, a pressuring member, a heat insulating member and a coil spring. The fixing member is arranged rotatably. The pressuring member is arranged rotatably and configured to come into pressure contact with the fixing member so as to form a fixing nip. The heat insulating member is configured to cover an outer circumference of at least one of the fixing member and the pressuring member and to curve in an arc shape. The coil spring is electrically grounded and configured to come into contact with an outer circumference face of the heat insulating member so as to curve in an arc shape.

8 Claims, 8 Drawing Sheets

FIXING DEVICE COMPRISING HEAT INSULATING MEMBER TO COVER OUTER CIRCUMFERENCE OF FIXING MEMBER AND IMAGE FORMING APPARATUS INCLUDING THE SAME

INCORPORATION BY REFERENCE

This application is based on and claims the benefit of priority from Japanese patent application No. 2014-129067 filed on Jun. 24, 2014, the entire contents of which are incorporated herein by reference.

BACKGROUND

The present disclosure relates to a fixing device fixing a toner image onto a recording medium and an image forming apparatus including the fixing device.

Conventionally, an electrographic image forming apparatus, such as a copying machine, a printer, a facsimile or a multifunction peripheral, includes a fixing device fixing a toner image onto a recording medium, such as a sheet. For example, there is a fixing device including a fixing member, a pressuring member configured to come into pressure contact with the fixing member and a heat insulating member configured to cover at least one of the fixing member and the pressuring member.

In the fixing device with such a configuration, it may be necessary to electrically ground the heat insulating member to prevent the potential of the heat insulating member from rising. However, it is difficult for a conventional fixing device to electrically ground the heat insulating member stably.

SUMMARY

In accordance with an embodiment of the present disclosure, a fixing device includes a fixing member, a pressuring member, a heat insulating member and a coil spring. The fixing member is arranged rotatably. The pressuring member is arranged rotatably and configured to come into pressure contact with the fixing member so as to form a fixing nip. The heat insulating member is configured to cover an outer circumference of at least one of the fixing member and the pressuring member and to curve in an arc shape. The coil spring is electrically grounded and configured to come into contact with an outer circumference face of the heat insulating member so as to curve in an arc shape.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
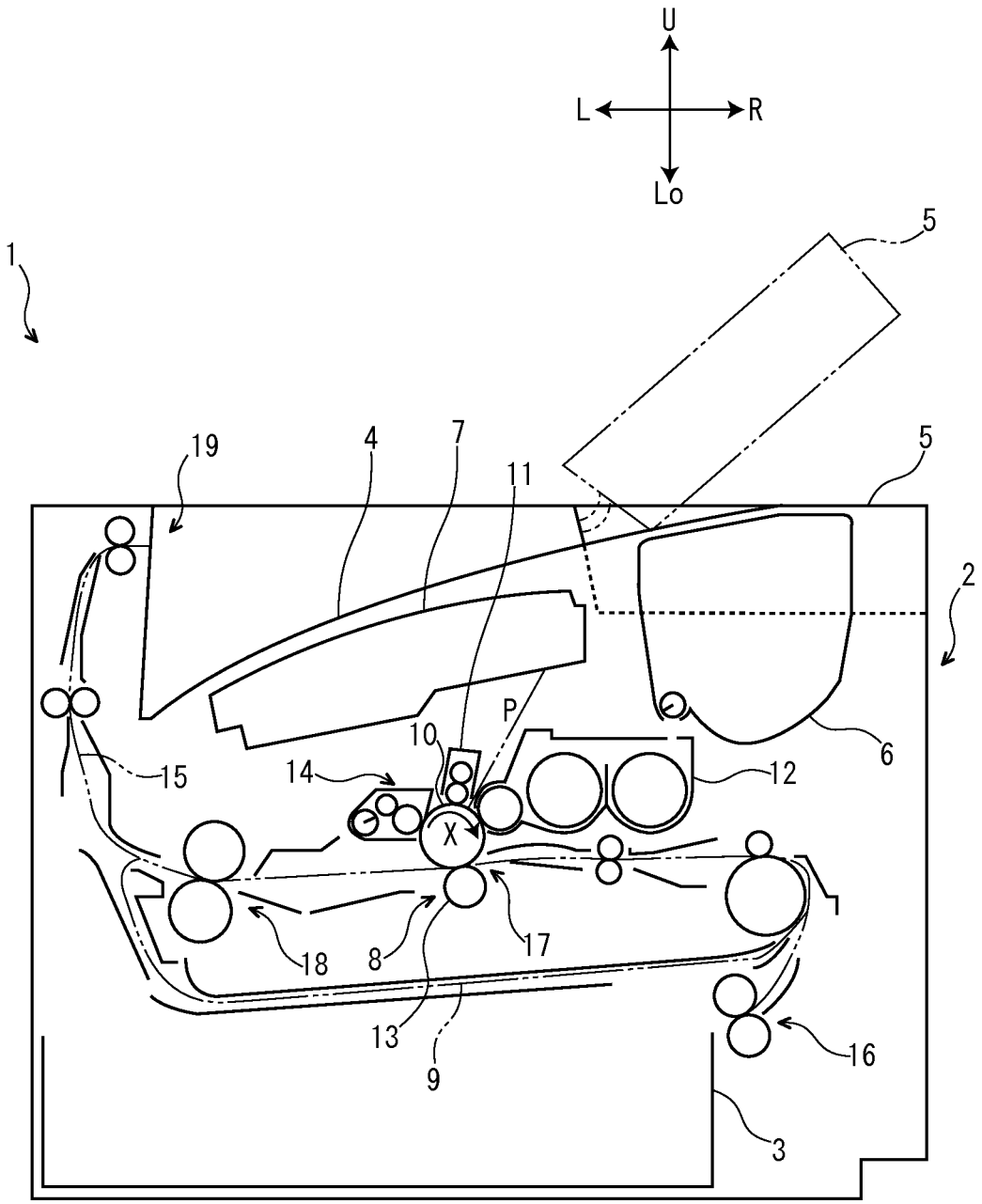
FIG. 1 is a schematic diagram schematically showing a printer according to an embodiment of the present disclosure.

First, with reference to FIG. 1, the entire structure of a printer 1 (an image forming apparatus) will be described. Arrows Fr, Rr, L, R, U and Lo of each figure indicate a front side, a rear side, a left side, a right side, an upper side and a lower side of the printer 1, respectively.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is arranged below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are arranged along a rotating direction (refer to an arrow X in FIG. 1) of the photosensitive drum 10.

Inside the printer main body 2, a conveying path 15 for the sheet is arranged. At an upstream end in the conveying path 15, a sheet feeding part 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 9 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner.

On the other hand, a sheet picked up from the sheet feeding cartridge 3 by the sheet feeding part 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed onto the sheet in the fixing device 18. The sheet with the fixed toner image is ejected from the sheet ejecting part 19 to the ejected sheet tray 4. The toner remained on the photosensitive drum 10 is collected by the cleaning device 14.

Next, a configuration of the fixing device 18 will be described.

Figure 2:
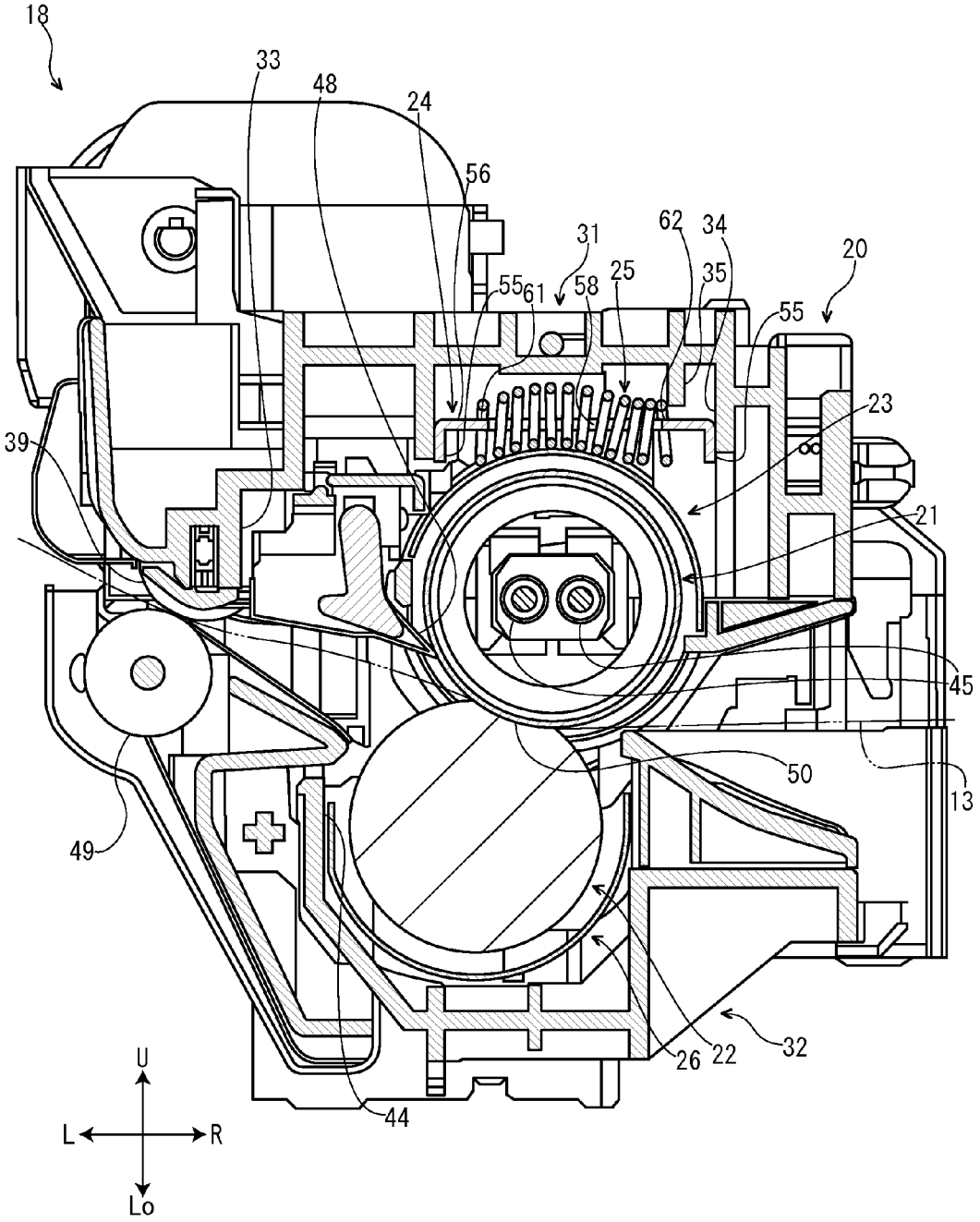
FIG. 2 is a sectional view showing a fixing device according to the embodiment of the present disclosure.

As shown in FIG. 2 and other figures, the fixing device 18 mainly includes a fixing frame 20 which is formed in a box-like shape, a fixing roller 21 (fixing member) which is housed in a nearly center part of the fixing frame 20, a pressuring roller 22 (pressuring member) which is housed in a lower part of the fixing frame 20, a first heat insulating plate 23 (heat insulating member) which is arranged at an upper side of the fixing roller 21, a holding plate 24 (holding member) and a coil spring 25 which are arranged at an upper side of the first heat insulating plate 23, and a second heat insulating plate 26 which is arranged at a lower side of the pressuring roller 22.

Figure 3:
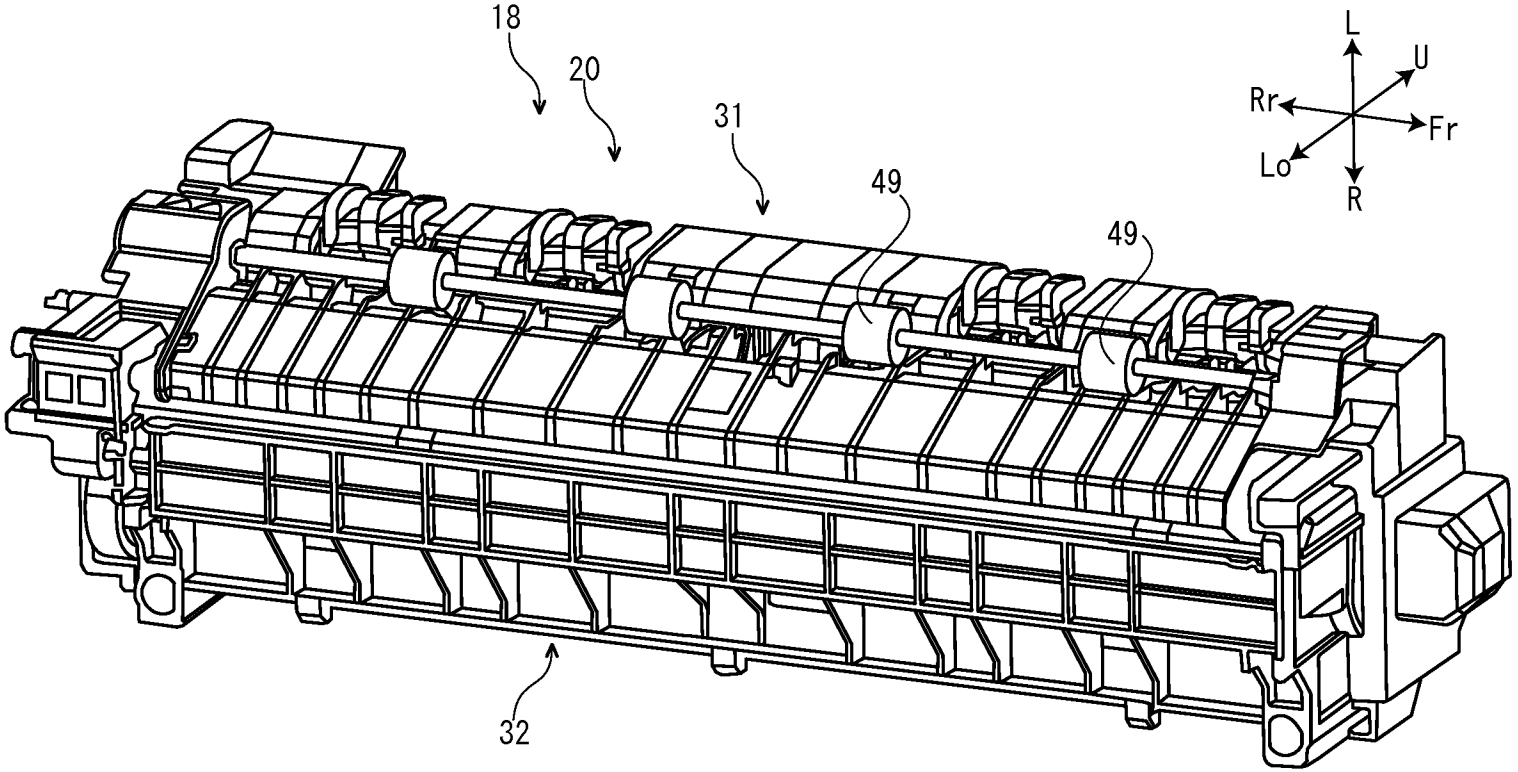
FIG. 3 is a perspective view showing the fixing device, as viewed from a lower side, according to the embodiment of the present disclosure.

As shown in FIG. 3 and other figures, the fixing frame 20 is formed in a shape elongated in a front and rear direction. The fixing frame 20 includes a first frame part 31, and a second frame part 32 which is arranged at a lower side of the first frame part 31.

As shown in FIG. 2 and other figures, the first frame part 31 of the fixing frame 20 is provided with a first housing part 33 which is opened to a lower side (second frame part 32 side). At an upper end part of the first housing part 33, a fitting recessed part 34 which is opened to the lower side (second frame part 32 side) is provided. At a right side part of the fitting recessed part 34, an engaging part 35 is provided in an upper and lower direction. At a left end part of the first frame part 31, a first ejecting roller 39 is provided.

Figure 4:
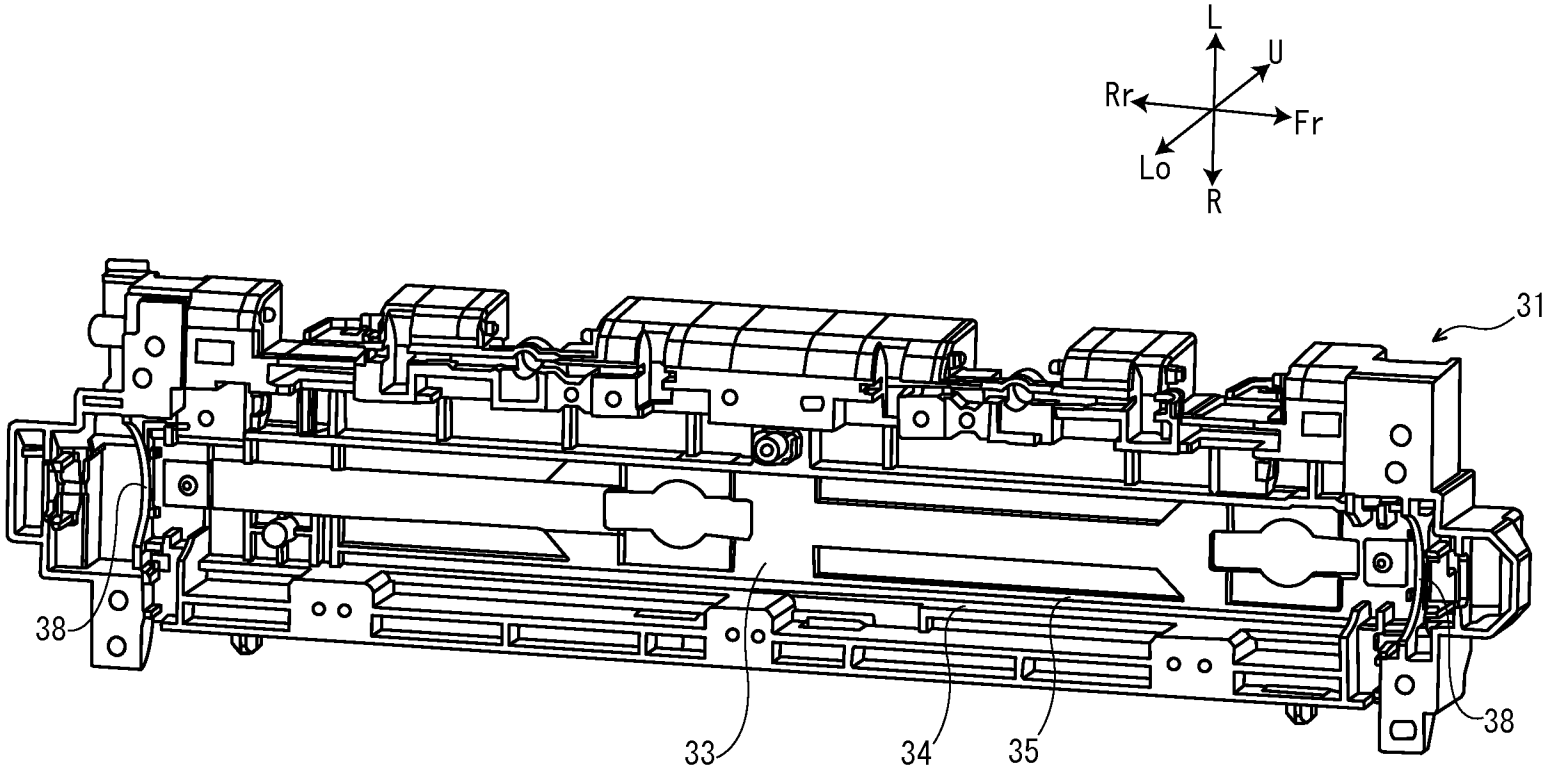
FIG. 4 is a perspective view showing a first frame part of a fixing frame in the fixing device according to the embodiment of the present disclosure.
Figure 5:
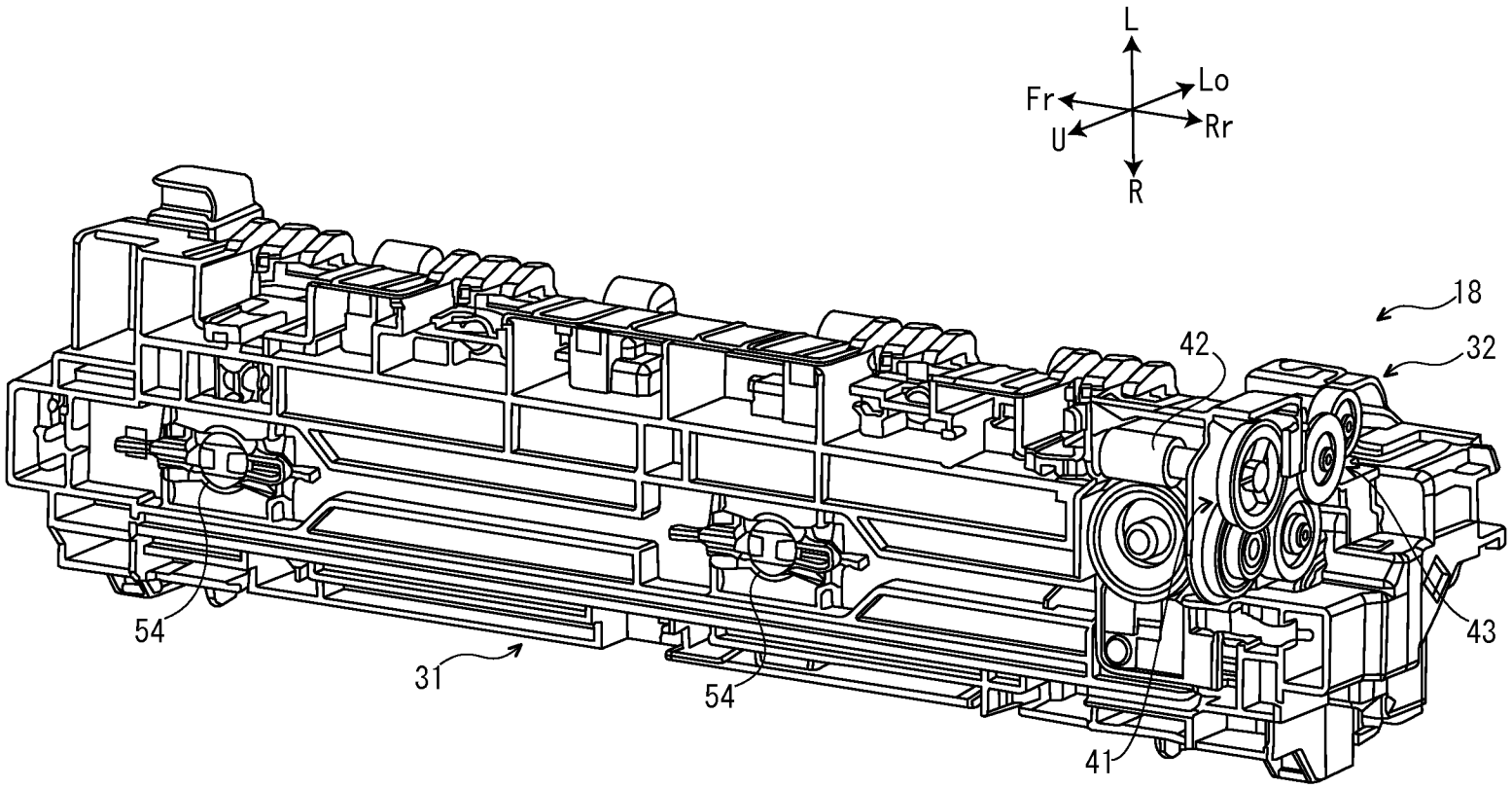
FIG. 5 is a perspective view showing the fixing device, as viewed from an upper side, according to the embodiment of the present disclosure.

As shown in FIG. 4 and other figures, at both front and rear end parts of the first frame part 31 of the fixing frame 20, engaging grooves 38 which are curved in a U shape to an upper side (a side separating from the second frame part 32) are provided. As shown in FIG. 5 and other figures, at a left side part of a rear end part of the first frame part 31, a driving unit 41 is provided. The driving unit 41 is provided with a driving motor 42, and a deceleration gear train 43 which is provided at the rear of the driving motor 42.

As shown in FIG. 2 and other figures, the second frame part 32 of the fixing frame 20 faces the first frame part 31 via the conveying path 15 for the sheet. The second frame part 32 is provided with a second housing part 44 which is opened to the upper side (first frame part 31 side). At the left end part of the second frame part 32, a second ejecting roller 49 which comes into pressure contact with the first ejecting roller 39 of the first frame part 31 is provided.

The fixing roller 21 is housed in the first housing part 33 of the first frame part 31 of the fixing frame 20. The fixing roller 21 includes a core material formed in a cylindrical shape and made of metal, such as aluminum or iron, an elastic layer provided around this core material and made of silicon rubber, and a release layer covering this elastic layer and made of fluororesin such as PFA.

In an inner space of the fixing roller 21, a pair of left and right heaters 45 (heat sources) are housed. Each heater 45 is composed of a halogen heater or a ceramic heater, for example. Each heater 45 is configured to generate a heat by being energized, and heat the fixing roller 21.

Figure 6:
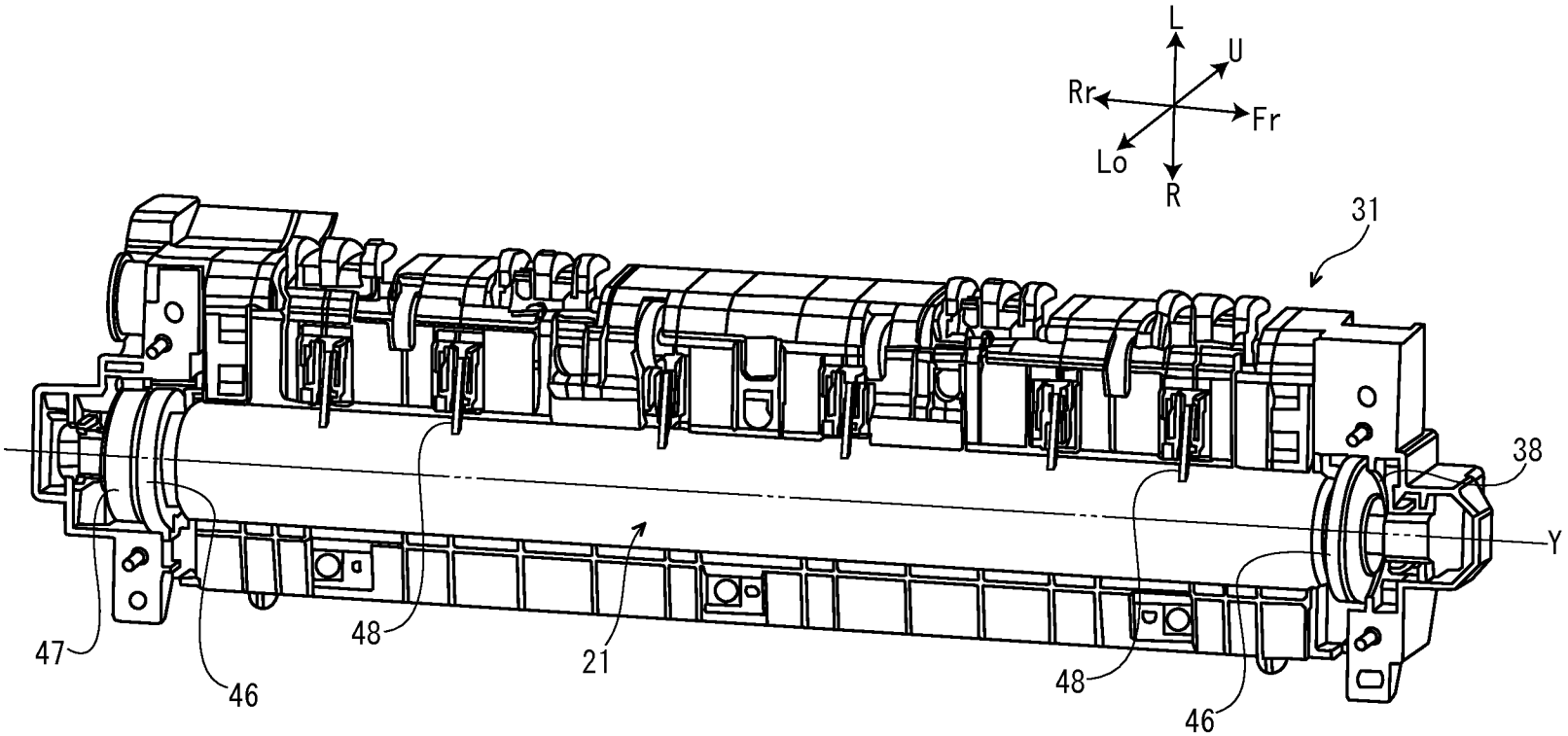
FIG. 6 is a perspective view showing a state that a fixing roller is attached to the first frame part of the fixing frame in the fixing device according to the embodiment of the present disclosure.

As shown in FIG. 6, an axial direction Y (longitudinal direction) of the fixing roller 21 is the front and rear direction. Between both front and rear end parts of the fixing roller 21 and the both front and rear end parts of the first frame part 31 of the fixing frame 20, bearings 46 are arranged. Thus, the fixing roller 21 is rotatably supported by the first frame part 31. Each bearing 46 comes into contact with each engaging groove 38 provided at the both front and rear end parts of the first frame part 31. Each bearing 46 is connected to the printer main body 2 (not shown in FIG. 6), and is electrically grounded via the printer main body 2. At the rear end part of the fixing roller 21, a driving gear 47 is fixed at a rear of the rear bearing 46. The driving gear 47 is connected to a deceleration gear train 43 of the driving unit 41.

At the left side of the fixing roller 21 (a downstream side in the sheet conveying direction), a plurality of separation claws 48 are provided with intervals in the front and rear directions. The right end part (distal end part) of each separation claw 48 comes into contact with an outer circumferential face of the fixing roller 21.

As shown in FIG. 2 and other figures, the pressuring roller 22 is housed in the second housing part 44 of the second frame part 32 of the fixing frame 20. The pressuring roller 22 includes a core material formed in a cylindrical shape and made of metal, such as aluminum or iron, for example, an elastic layer provided around this core material and made of silicon rubber, and a release layer covering this elastic layer and made of fluororesin such as PFA.

The pressuring roller 22 is rotatably supported by the second frame part 32 of the fixing frame 20. The pressuring roller 22 is formed in a shape elongated in the front and rear direction. The pressuring roller 22 comes into pressure contact with the fixing roller 21 so as to form a fixing nip 50 between the fixing roller 21 and the pressuring roller 22.

The first heat insulating plate 23 is provided to cover the outer circumference of the fixing roller 21 from an upper side, and is curved in an arc shape along the outer circumferential face of the fixing roller 21. The first heat insulating plate 23 presses the holding plate 24 to the upper side (a side separating from the second frame part 32) via the coil spring 25.

Figure 7:
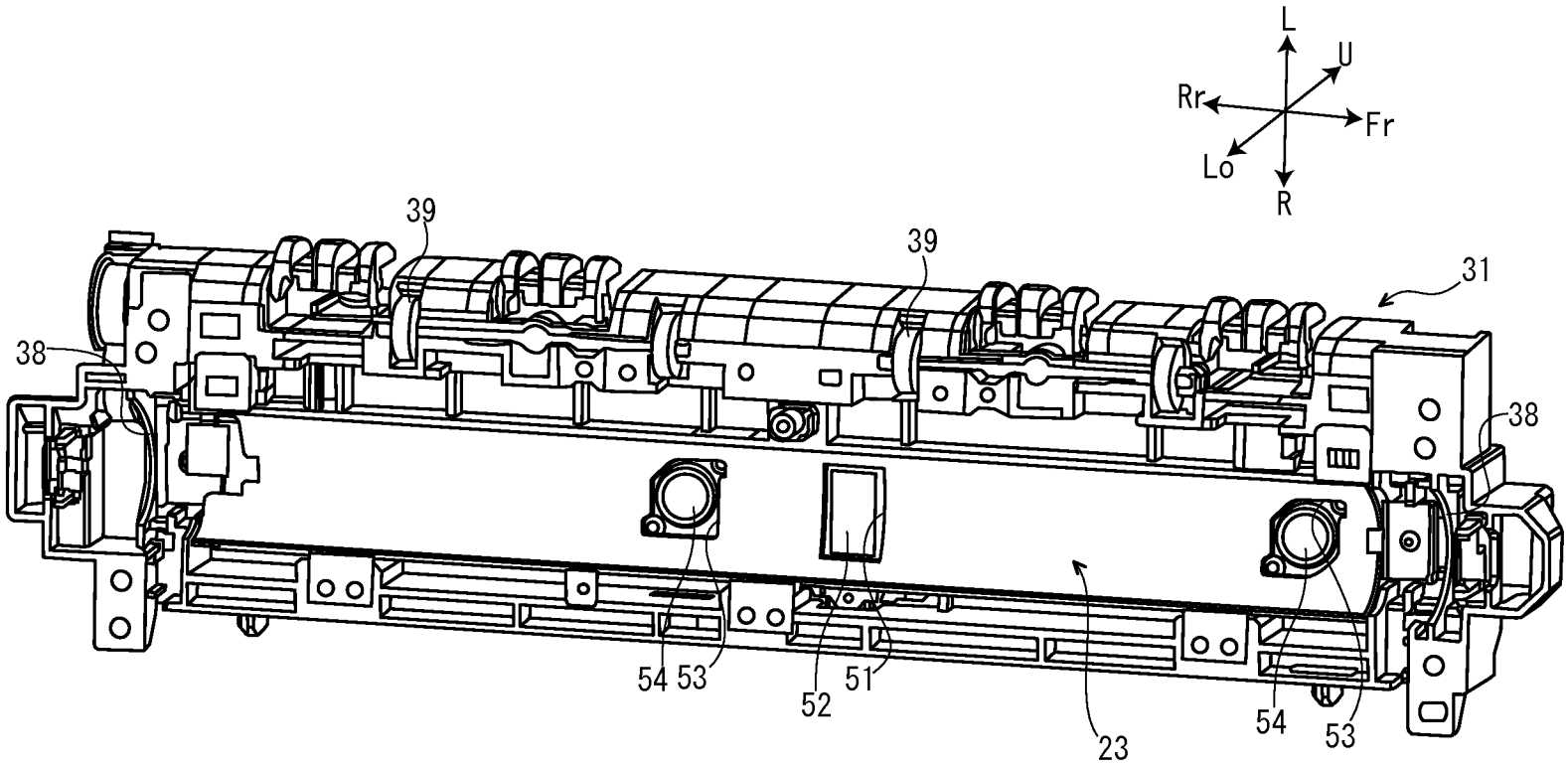
FIG. 7 is a perspective view showing a state that the fixing roller is removed from the first frame part of the fixing frame in the fixing device according to the embodiment of the present disclosure.

As shown in FIG. 7 and other figures, at a nearly center part in the front and rear direction of the first heat insulating plate 23, a thermistor opening 51 is formed, and a thermistor 52 (temperature detecting member) which detects the temperature of the fixing roller 21 faces the outer circumferential face of the fixing roller 21 (not shown in FIG. 7) via this thermistor opening 51. At the nearly center part in the front and rear direction and the front end part of the first heat insulating plate 23, thermocut openings 53 are formed, and a pair of thermocuts 54 face the outer circumferential face of the fixing roller 21 via the respective thermocut openings 53.

As shown in FIG. 2 and other figures, the holding plate 24 is arranged between the first frame part 31 of the fixing frame 20 and the first heat insulating plate 23. The holding plate 24 includes a pair of left and right fitting plates 55 provided in the upper and lower direction, and a connecting plate 56 which is provided in the left and right direction and connects the upper end parts of the fitting plates 55.

Each fitting plate 55 of the holding plate 24 fits from the inside to the fitting recessed part 34 of the first frame part 31 of the fixing frame 20. Thus, the holding plate 24 is fixed to the first frame part 31.

Figure 8:
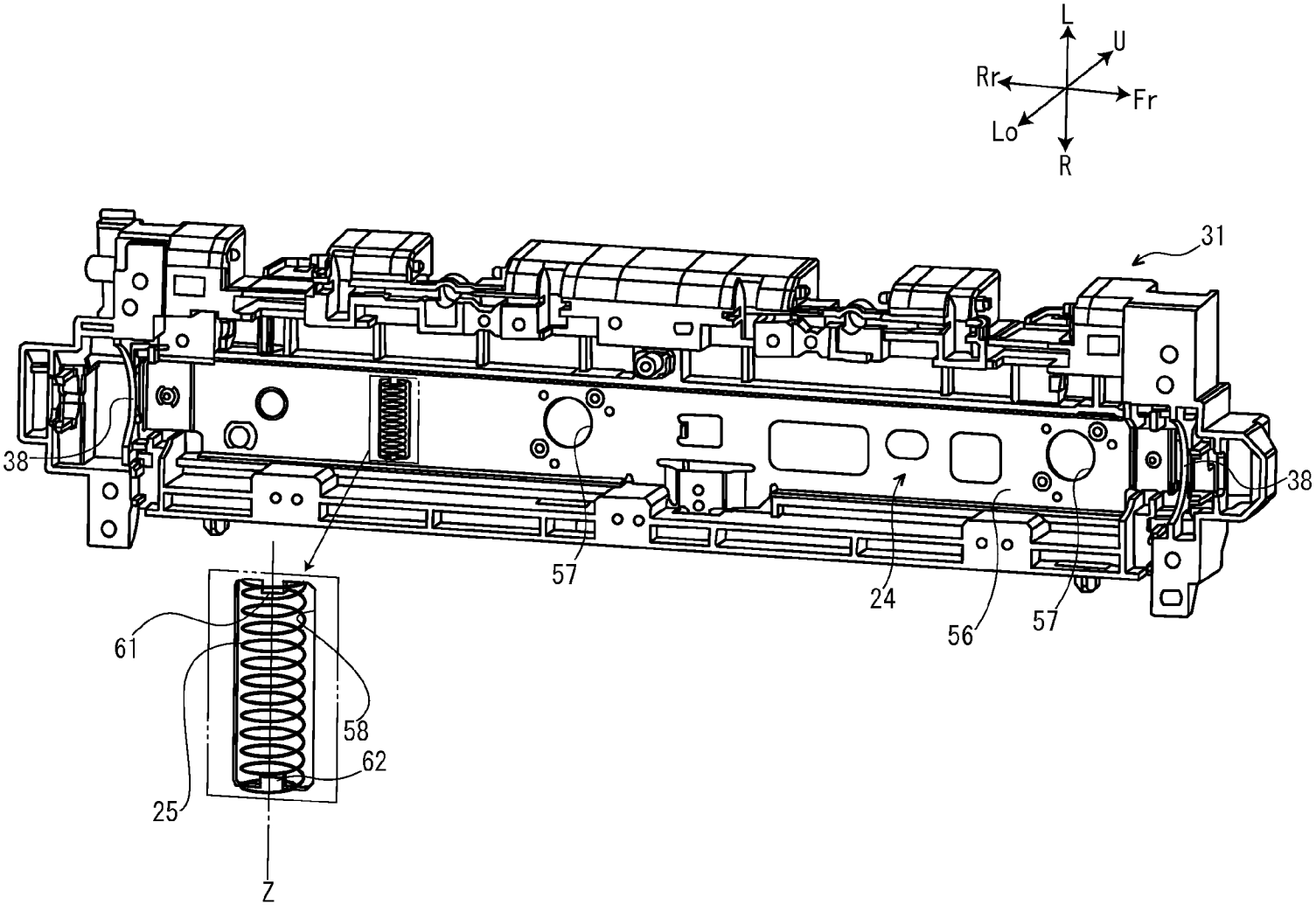
FIG. 8 is a perspective view showing a state that the fixing roller and a first heat insulating plate are removed from the first frame part of the fixing frame in the fixing device according to the embodiment of the present disclosure.

As shown in FIG. 8 and other figures, at the nearly center part in the front and rear direction and the front end part of the connecting plate 56 of the holding plate 24, through holes 57 are provided, and each thermocut 54 (not shown in FIG. 8) faces the outer circumferential face of the fixing roller 21 (not shown in FIG. 8) via each through hole 57. At the rear part of the connecting plate 56, an insertion hole 58 (which is enlarged in FIG. 8) is provided. The insertion hole 58 is formed in a rectangular shape elongated in the left and right direction. In the connecting plate 56, at a left edge part (inner edge part) of the insertion hole 58, an engaging part 61 is provided, and, at a right edge part (inner edge part) of the insertion hole 58, an engaging part 62 is provided.

An axial core direction Z of the coil spring 25 is left and right direction. The coil spring 25 is a compression spring provided in a compressed state compared with natural length, for example. As shown in FIG. 2 and other figures, the coil spring 25 comes into contact with the outer circumferential face of the first heat insulating plate 23, and is curved in an arc shape along the outer circumferential face of the first heat insulating plate 23.

As shown in FIG. 8 and other figures, the coil spring 25 is inserted into the insertion hole 58 of the connecting plate 56 of the holding plate 24. The left end part of the coil spring 25 is engaged with the engaging part 61 of the connecting plate 56 of the holding plate 24, and the right end part of the coil spring 25 is engaged with the engaging part 62 of the connecting plate 56 of the holding plate 24. According to this configuration, the coil spring 25 is held by the holding plate 24. The coil spring 25 is connected with each bearing 46 (see FIG. 6 and other figures) of the fixing roller 21 via the holding plate 24 and the first frame part 31 of the fixing frame 20 so as to be electrically grounded.

As shown in FIG. 2 and other figures, the second heat insulating plate 26 is provided to cover the outer circumference of the pressuring roller 22 from a lower side, and is curved in an arc shape along the outer circumferential face of the pressuring roller 22.

In the fixing device 18 configured as described above, the driving motor 42 of the driving unit 41 is rotated to fix toner images on the sheet. When the driving motor 42 is rotated in this way, the rotation of the driving motor 42 is transmitted to the fixing roller 21 via the deceleration gear train 43 and the driving gear 47 to rotate the fixing roller 21. When the fixing roller 21 is rotated in this way, the pressuring roller 22 which comes into pressure contact with the fixing roller 21 is driven and rotated in a direction opposite to that of the fixing roller 21. Further, a pair of heaters 45 heat the fixing roller 21 to fix a toner image on the sheet. When the sheet on which an unfixed toner image is formed is conveyed in this state from the upstream side (right side) along the conveying path 13, the sheet passes through the fixing nip 50. Thus, the sheet and the toner image are heated and pressured so as to fix the toner image on the sheet. The sheet having passed through the fixing nip 50 is separated from the outer circumferential face of the fixing roller 21 by each separation claw 48, and is ejected to the outside of the fixing device 18 by the first ejecting roller 39 and the second ejecting roller 49.

As described above, according to the present embodiment, the first heat insulating plate 23 is provided to cover the outer circumference of the fixing roller 21 from the upper side, and the first heat insulating plate 23 is curved in the arc shape along the outer circumferential face of the fixing roller 21. Consequently, it is possible to effectively prevent a heat of the fixing roller 21 from escaping to the outside, and enhance a heat insulation property of the fixing roller 21.

Meanwhile, to enhance the heat insulation property of the fixing roller 21 by using the first heat insulating plate 23 as described above, it is necessary to prevent the potential of the first heat insulating plate 23 from rising by electrically grounding the first heat insulating plate 23. According to the present embodiment in particular, it is necessary to electrically ground the first heat insulating plate 23 by using a small space between the first heat insulating plate 23 and the holding plate 24. In such a case, when, for example, an electrically grounded leaf spring is in contact with the first heat insulating plate 23 so as to electrically ground the first heat insulating plate 23, if a load is applied to the leaf spring, the leaf spring is likely to lose a resilience (the leaf spring is likely to plastically deform in a load direction). According to this, there is a concern that a state where the first heat insulating plate 23 is insufficiently electrically grounded is caused. Further, when the leaf spring is used as described above, a mold for manufacturing the leaf spring is required, and therefore there is a concern that cost to manufacture the fixing device 18 rises.

By contrast with this, according to the present embodiment, the electrically grounded coil spring 25 is curved in the arc shape by being in contact with the outer circumferential face of the first heat insulating plate 23 as described above. By applying such a configuration, a contact area of a spring (a spring for electrically grounding the first heat insulating plate 23) and the first heat insulating plate 23 becomes larger compared to a case where a leaf spring is used, so that it is possible to electrically ground the first heat insulating plate 23 stably. Further, it is possible to place the coil spring 25 and the first heat insulating plate 23 in contact with each other via a plurality of portions, and, consequently, it is possible to electrically ground the first heat insulating plate 23 stably and to prevent grounding failure. Furthermore, when the coil spring 25 is used as described above, a mold for manufacturing a spring is not required, so that it is possible to reduce cost to manufacture the fixing device 18 compared to a case where a leaf spring is used.

Still Further, according to the present embodiment, as described above, the second heat insulating plate 26 is provided to cover the outer circumference of the pressuring roller 22 from the lower side, and the second heat insulating plate 26 is curved in an arc shape along the outer circumferential face of the pressuring roller 22. Consequently, it is possible to effectively prevent a heat of the pressuring roller 22 from escaping to the outside, and enhance the heat insulation property of the pressuring roller 22.

Further, the holding plate 24 arranged between the first frame part 31 of the fixing frame 20 and the first heat insulating plate 23 holds the coil spring 25. By applying such a configuration, it is possible to reliably hold the coil spring 25 while preventing the first frame part 31 of the fixing frame 20 from thermally deforming.

Further, the coil spring 25 is connected with each bearing 46 of the fixing roller 21 via the holding plate 24 and the first frame part 31 of the fixing frame 20 so as to be electrically grounded. By applying such a configuration, it is possible to electrically ground the coil spring 25 stably.

Further, the first heat insulating plate 23 presses the holding plate 24 to the upper side (the side separating from the second frame part 32) via the coil spring 25. By applying such a configuration, it is possible to prevent the holding plate 24 fitted to the fitting recessed part 34 from being unintentionally detached.

Further, the connecting plate 56 of the holding plate 24 is provided with the insertion hole 58 into which the coil spring 25 can be inserted, and the left end part of the coil spring 25 is engaged with the engaging part 61 provided at the left edge part of the insertion hole 58 and the right end part of the coil spring 25 is engaged with the engaging part 62 provided at the right edge part of the insertion hole 58. By applying such a configuration, a simple configuration makes it possible to hold the coil spring 25.

Further, the coil spring 25 is composed of a compression spring arranged in the compressed state compared with the natural length. By applying such a configuration, it is not necessary to form, in the holding plate 24, a hook at which the both left and right end parts of the coil spring 25 are hooked, and it is possible to simplify the configuration of the holding plate 24. Further, it is possible to arrange the coil spring 25 from the left edge part to the right edge part of the insertion hole 58, and further increase the contact area of the coil spring 25 and the first heat insulating plate 23.

Further, the axial core direction Z (left and right direction) of the coil spring 25 is orthogonal to the axial direction Y (front and rear direction) of the fixing roller 21. By applying such a configuration, it is possible to reliably deform the coil spring 25 along the arc shape of the first heat insulating plate 23.

In the present embodiment, a case where the coil spring 25 is held by the holding plate 24 has been described. However, in another embodiment, the coil spring 25 may be directly held by the fixing frame 20.

In the present embodiment, a case where the coil spring 25 is composed of the compression spring arranged in the compressed state compared with the natural length has been described. Meanwhile, in another embodiment, the coil spring 25 may be composed of a tension spring arranged in a stretched state compared with natural length.

In the present embodiment, a case where the configuration of the present disclosure is applied to the first heat insulating plate 23 covering the fixing roller 21 has been described. Meanwhile, in another embodiment, the configuration of the present disclosure may be applied to the second heat insulating plate 26 covering the pressuring roller 22 or the configuration of the present disclosure may be applied to both of the first heat insulating plate 23 and the second heat insulating plate 26.

In the present embodiment, a case where a fixing member is composed of the fixing roller 21 and a pressuring member is composed of the pressuring roller 22 has been described. Meanwhile, in another embodiment, one or both of the fixing member and the pressuring member may be composed of a belt.

In the present embodiment, a case of using the heater 45 as the heat source has been described. In another embodiment, an IH coil or the like may be used as the heat source.

The embodiment was described in a case of applying the configuration of the present disclosure to the printer 1. In another embodiment, the configuration of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing member arranged rotatably;

a pressuring member arranged rotatably and configured to come into pressure contact with the fixing member so as to form a fixing nip;

a heat insulating member configured to cover an outer circumference of the fixing member and to curve in an arc shape;

a coil spring electrically grounded and configured to come into contact with an outer circumference face of the heat insulating member so as to curve in an arc shape;

a fixing frame configured to rotatably support the fixing member and the pressuring member; and a holding member arranged between the fixing frame and the heat insulating member, wherein the coil spring is held by the holding member.

2. The fixing device according to claim 1, further comprising a bearing electrically grounded and arranged between the fixing frame and the fixing member, wherein the coil spring is connected to the bearing via the holding member and the fixing frame so as to be electrically grounded.

3. The fixing device according to claim 1, wherein the holding member has an insertion hole into which the coil spring is inserted, both end parts of the coil spring in an axial core direction are engaged with an inner edge part of the insertion hole.

4. The fixing device according to claim 1, further comprising a temperature detecting member configured to detect temperature of the fixing member, wherein the temperature detecting member is configured to face an outer circumference face of the fixing member via an opening formed in the heat insulating member.

5. The fixing device according to claim 1, wherein the fixing member is a fixing roller configured to house a heat source.

6. An image forming apparatus comprising the fixing device according to claim 1.

7. A fixing device comprising:

a fixing member arranged rotatably;

a pressuring member arranged rotatably and configured to come into pressure contact with the fixing member so as to form a fixing nip;

a heat insulating member configured to cover an outer circumference of the fixing member and to curve in an arc shape; and a coil spring electrically grounded and configured to come into contact with an outer circumference face of the heat insulating member so as to curve in an arc shape, wherein the coil spring is composed of a compression spring provided in a compressed state compared with natural length.

8. A fixing device comprising:

a fixing member arranged rotatably;

a pressuring member arranged rotatably and configured to come into pressure contact with the fixing member so as to form a fixing nip;

a heat insulating member configured to cover an outer circumference of the fixing member and to curve in an arc shape; and a coil spring electrically grounded and configured to come into contact with an outer circumference face of the heat insulating member so as to curve in an arc shape, wherein an axial core direction of the coil spring is orthogonal to an axial direction of the fixing member.

* * * * *